US007433638B2

(12) United States Patent
Ide et al.

(10) Patent No.: US 7,433,638 B2
(45) Date of Patent: Oct. 7, 2008

(54) FIXING DEVICE FOR FUSING AND FIXING AN UNFIXED DEVELOPER ONTO A RECORDING MEDIUM, AND IMAGE FORMING DEVICE HAVING THE SAME

(75) Inventors: Atsushi Ide, Nara (JP); Hiroaki Hori, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 253 days.

(21) Appl. No.: 11/240,591

(22) Filed: Oct. 3, 2005

(65) Prior Publication Data

US 2006/0072945 A1 Apr. 6, 2006

(30) Foreign Application Priority Data

Oct. 5, 2004 (JP) ..... P 2004-292775

(51) Int. Cl.
*G03G 15/20* (2006.01)

(52) U.S. Cl. ..... 399/327

(58) Field of Classification Search ..... 399/326, 399/327, 352; 219/216; 226/918; 15/256.51, 15/256.52; 101/425
See application file for complete search history.

(56) References Cited

U.S. PATENT DOCUMENTS 5,168,314 A * 12/1992 Gunji et al. ..... 399/327
5,636,012 A * 6/1997 Uneme et al. ..... 399/325
5,848,341 A * 12/1998 Watanabe ..... 399/352
2006/0029441 A1 * 2/2006 Ide et al. ..... 399/327

FOREIGN PATENT DOCUMENTS

| | | | |
|---|---|---|---|
| JP | 58182671 A | * | 10/1983 |
| JP | 5-204274 A | | 8/1993 |
| JP | 05204274 A | * | 8/1993 |
| JP | 09281838 A | * | 10/1997 |
| JP | 2000029351 A | * | 1/2000 |
| JP | 2001-100583 A | | 4/2001 |
| JP | 2001-215838 A | | 8/2001 |
| JP | 2002-229371 A | | 8/2002 |
| JP | 2003-107952 A | | 4/2003 |
| JP | 2003233265 A | * | 8/2003 |

* cited by examiner

*Primary Examiner*—Robert Beatty
(74) *Attorney, Agent, or Firm*—Birch, Stewart, Kolasch & Birch, LLP

(57) ABSTRACT

A fixing device includes a feeding roller for feeding a belt-shaped cleaning member which has been rolled up, and a winding roller for taking up the cleaning member which has been fed from the feeding roller and cleaned the surface of the fixing roller. Each of the feeding roller and the winding roller rotates by a time control of a control portion so that a sum of a feed amount of the cleaning member which is fed by the feeding roller at one feeding occasion, and a take-up amount of the cleaning member which is taken up by the winding roller at one take-up occasion, is equal to or more than a double of a length Ln of a nip section.

8 Claims, 11 Drawing Sheets

FIG. 5

| | | ROTATIONAL ANGLE OF WINDING ROLLER (° ) | LENGTH OF DRIVING TIME OF WINDING ROLLER (sec.) | TAKE-UP LENGTH OF CLEANING MEMBER (mm) | ROTATIONAL ANGLE OF FEEDING ROLLER (° ) | LENGTH OF TIME OF DRIVING FEEDING ROLLER (sec.) | FEED LENGTH OF CLEANING MEMBER (mm) |
|---|---|---|---|---|---|---|---|
| $n_1$ | INITIAL STATE (IMMEDIATE AFTERMATH OF REPLACEMENT OF CLEANING MEMBER) | 200 | 3.33 | 10.5 | 60 | 1.0 | 10.5 |
| $n_m$ | MIDCOURCE OF LIFE SPAN (WINDING/FEEDING ROLLER DIAMETES: BOTH 13$\phi$mm) | 93 | 1.55 | 10.5 | 93 | 1.55 | 10.5 |
| $n_e$ | ENDING LIFE SPAN (IMMEDIATE BEFOREMATH OF REPLACEMENT OF CLEANING MEMBER) | 60 | 1.0 | 10.5 | 200 | 3.33 | 10.5 |

FIG. 8

| TYPES OF SHEET | PRINT RATIO | ROTATION CYCLE OF WINDING ROLLER (ONE TIME/NUMBEROF PRINTING SHEETS) | CONVERSION RATE TO A4 WIDTHWISE |
|---|---|---|---|
| A3 | 5% OR LESS | 10 SHEETS | ×2.00 |
| | 5 TO 8% | 7 SHEETS | |
| | 8 TO 12% | 5 SHEETS | |
| | 12% OR MORE | 3 SHEETS | |
| B4 | 5% OR LESS | 10 SHEETS | ×2.00 |
| | 5 TO 8% | 7 SHEETS | |
| | 8 TO 12% | 5 SHEETS | |
| | 12% OR MORE | 3 SHEETS | |
| A4 LENGTHWISE CONVEYANCE | 5% OR LESS | 15 SHEETS | ×1.33 |
| | 5 TO 8% | 10 SHEETS | |
| | 8 TO 12% | 7 SHEETS | |
| | 12% OR MORE | 5 SHEETS | |
| A4 WIDTHWISE CONVEYANCE | 5% OR LESS | 20 SHEETS | ×1.00 |
| | 5 TO 8% | 15 SHEETS | |
| | 8 TO 12% | 10 SHEETS | |
| | 12% OR MORE | 6 SHEETS | |
| B5/SMALL SIZE SHEET SUCH AS POSTCARD | 5% OR LESS | 30 SHEETS | ×0.67 |
| | 5 TO 8% | 20 SHEETS | |
| | 8 TO 12% | 15 SHEETS | |
| | 12% OR MORE | 10 SHEETS | |

FIG. 9

| TYPES OF SHEET | PRINT RATIO | ROTATION CYCLE OF WINDING ROLLER (ONE TIME/NUMBEROF PRINTING SHEETS) | CONVERSION RATE TO A4 WIDTHWISE AND PRINT RATIO OF 5% OR LESS |
|---|---|---|---|
| A4 WIDTHWISE CONVEYANCE | 5% OR LESS | 20 SHEETS | ×1.00 |
| | 5 TO 8% | 15 SHEETS | ×1.33 |
| | 8 TO 12% | 10 SHEETS | ×2.00 |
| | 12% OR MORE | 6 SHEETS | ×3.33 |

FIXING DEVICE FOR FUSING AND FIXING AN UNFIXED DEVELOPER ONTO A RECORDING MEDIUM, AND IMAGE FORMING DEVICE HAVING THE SAME

BACKGROUND OF THE INVENTION

1. Field of the Invention

The present invention relates to a fixing device favorably for use in an electrophotographic image forming apparatus, and to an image forming apparatus having the same.

2. Description of the Related Art

In an image formation using an electrophotographic system, a photoreceptor charged with a uniform electric potential is exposed to a light in accordance with image information so that an electrostatic latent image is formed. The formed electrostatic latent image is developed by a developer so as to be visualized. The visualized image is transferred on a recording paper or the like, and the transferred developer on the recording paper is made to be fixed so as to form a solid recording image.

The fixing device used for such image formation, is generally composed of a heating roller and a pressure roller, which are such configured that unfixed developer is fused and fixed by heating of the heating roller and pressing of the pressure roller when passing the recording paper on which the developer for forming a visualized image through a contact region (hereinafter sometimes referred to as a nip section) of the both rollers, which region is formed by pressing the pressure roller against the heating roller.

During a fixing operation in the fixing device, there sometimes occurs a so-called hot offset that the developer fused on the nip section of the both rollers is not all fixed on the recording paper, but a part of the developer is attached to a surface of the roller. For instance, the developer attached to the heating roller is transferred on a portion which should be properly a white base, on a recording paper on which the developer is to be subsequently fixed, with the result that an image defect is made to occur.

Moreover, on the pressure roller, the developer which has already fixed to a back surface of the conveyed recording paper, for instance as in a case of duplex print, may be sometimes fused again by heat when passing through the nip section and a part of the developer may be transferred and attached to the pressure roller. The developer thus attached to the pressure roller may cause the image defect and further, may cause a soil of the back surface of the recording paper.

The image defect caused by the hot offset in the fixing device sometimes remains, in a case of black-and-white print, mere defects such as a fog in a white base of the formed image, a soil on the back surface of the recording paper, or the like in a tolerable range. However, in a case of full-color print, since a developer having a color different from a prescribed one is transferred from the both rollers, there often occur practically intolerable defects.

As a related art for solving such a problem, there is an apparatus having roller cleaning means on the both rollers provided in a fixing device (refer to Japanese Unexamined Patent Publication JP-A 2003-107952).

FIG. 11 is a schematic view showing a configuration of roller cleaning means 1 provided in a related art fixing device. FIG. 11 illustrates the roller cleaning means 1 provided on a heating roller 2 in the fixing device.

The roller cleaning means 1 comprises a feeding roller 4 for feeding a belt-shaped cleaning member 3 which has been previously rolled up, a winding roller 5 for taking up the cleaning member 3 fed from the feeding roller 4, and a pressure-contact roller 6 (also referred to as a web pressure-contact roller) provided between the feeding roller 4 and the winding roller 5 so as to press the cleaning member 3 against the heating roller 2.

The roller cleaning means 1 presses the cleaning member 3 against the heating roller 2 which rotates in an arrow sign 7 direction in a state where the winding roller 5, the feeding roller 4, and the pressure-contact roller 6 are made to be at rest without being made to rotate so that the heating roller 2 and the cleaning member 3 are made to be slidingly scrubbed. By so doing, a developer 8*a* attached in a fused state to an outer circumferential surface of the heating roller 2 is removed, and the removed developer 8*b* is accumulated, still in a substantially fused state, in a gap formed by the cleaning member 3 located between the pressure-contact roller 6 and the winding roller 5, and the surface of the heating roller 2.

A cleaning capability is lowered when the developer 8*b* accumulated in the gap is excessively accumulated. Accordingly, when the developer 8*b* accumulated in the gap reaches a certain amount level, the roller cleaning means 1 feeds the cleaning member 3 by making the feeding roller 4 rotate in an arrow sign 10 direction, as well as takes up the cleaning member 3 by making the pressure contact-roller 6 rotate in an arrow sign 11 direction and further operates the winding roller 5 for take-up in an arrow sign 9 direction, with the result that the developer 8*b* is made to be detached from the surface of the heating roller 2 in a state where the developer 8*b* is attached to the cleaning member 3.

When this feed amount of the cleaning member 3 due to the feeding roller 4 is small, a portion of the cleaning member 3 which has been used once for cleaning cannot be completely renewed. Consequently, it is impossible to sufficiently recover the cleaning capability in spite of a fact that the cleaning member 3 is fed out. In contrast, when the feed amount of the cleaning member 3 is too large, a clean portion of the cleaning member 3 is unnecessarily consumed. Consequently, a running cost is increased.

In addition, when a take-up amount due to the winding roller 5 is small with respect to the feed amount of the cleaning member 3 due to the feeding roller 4, the fed cleaning member 3 is made impossible to show a sufficient cleaning capability by being slackened between the feeding roller 4 and the winding roller 5. In contrast, when the take-up amount due to the winding roller 5 is large with respect to the feed amount of the cleaning member 3 due to the feeding roller 4, an excessive tension is loaded on the cleaning member 3. In a case where the tension is extreme, the cleaning member 3 may be broken apart.

As described above, a control of the feed amount and take-up amount of the cleaning member 3 is extremely important in the cleaning means 1. However, there is neither disclosure nor suggestion on this matter in Japanese Unexamined Patent Publication JP-A 2003-107952.

SUMMARY OF THE INVENTION

An object of the invention is to provide a fixing device capable of controlling feed amount and take-up amount of a cleaning member when cleaning is performed by making a belt-shaped cleaning member contact a fixing roller (a heating roller or a pressure roller), and an image forming apparatus having the fixing device.

The invention provides a fixing device for fusing and fixing an unfixed developer onto a recording medium, comprising:

fixing rollers which form a pair of rotators, a recording medium which has an image of an unfixed developer thereon being passed through a pressure-contact section formed by the fixing rollers;

a belt-shaped cleaning member provided so as to contact at least either one of fixing rollers, for cleaning a surface of the fixing roller;

a pressure-contact roller provided so as to press the cleaning member against the fixing roller which is in contact with the cleaning member, and form a nip section serving as a pressing portion;

a feeding roller for feeding the belt-shaped cleaning member which has been rolled up;

a winding roller for taking up the cleaning member which has been fed from the feeding roller and cleaned the surface of the fixing roller; and control means for controlling rotary operation of the feeding roller and winding roller so that a sum of a feed amount of the cleaning member which is fed by the feeding roller at one feeding occasion, and a take-up amount of the cleaning member which is taken up by the winding roller at one take-up occasion, is equal to or more than a double of a length of the nip section in a circumferential direction of the pressure-contact roller.

According to the invention, the control means provided in the fixing device controls the rotary operation of the feeding roller and winding roller so that the sum of the feed amount of the cleaning member which is fed by the feeding roller at one feeding occasion, and the take-up amount of the cleaning member which is taken up by the winding roller at one take-up occasion, is equal to or more than a double of the length of the nip section in the circumferential direction of the pressure-contact roller. By so ding, the cleaning member of a larger amount of the length of the nip section is fed and taken up at every one feeding/take-up occasion. Accordingly, a clean cleaning member having a sufficient length can be fed to the nip section so that it is made possible to reliably recover the cleaning capability.

Further, in the invention, it is preferable that the feed amount of the cleaning member which is fed by the feeding roller at one feeding occasion is determined according to a length of rotational time of the feeding roller controlled by the control means, and the take-up amount of the cleaning member which is taken up by the winding roller at one take-up occasion is determined according to a length of rotational time of the winding roller controlled by the control means.

Further, according to the invention, the feed amount of the cleaning member which is fed by the feeding roller at one feeding occasion and the take-up amount of the cleaning member which is taken up by the winding roller at one take-up occasion are determined according to the lengths of rotational time of the respective rollers controlled by the control means. A rotating speed of the roller is made to be constant and the lengths of rotational time of the rollers are determined, and thereby it is made possible to set the feed amount and take-up amount of the cleaning member with high accuracy.

Further, in the invention, it is preferable that the control means controls each of the feeding roller and the winding roller with respect to the length of rotational time so that the feed amount of the cleaning member which is fed by the feeding roller at one feeding occasion, and the take-up amount of the cleaning member which is taken up by the winding roller at one take-up occasion, are equal.

Further, according to the invention, the control means controls each of the feeding roller and the winding roller with respect to the length of rotational time so that the feed amount of the cleaning member which is fed by the feeding roller at one feeding occasion, and the take-up amount of the cleaning member which is taken up by the winding roller at one take-up occasion, are equal. Consequently, it is made possible to conform the feed amount to the take-up amount with high accuracy.

Further, in the invention, it is preferable that the control means controls the rotary operation of the winding roller so that the length of rotational time of the winding roller is shorter than that of rotational time needed for taking up the cleaning member at one take-up occasion by an amount which is equal to the amount of the cleaning member fed by the feeding roller at one feeding occasion.

Further, according to the invention, the control means controls the rotary operation of the winding roller so that the length of rotational time of the winding roller is shorter than that of rotational time needed for taking up the cleaning member at one take-up occasion by the amount which is equal to the amount of the cleaning member fed by the feeding roller at one feeding occasion. By so doing, even in a case where the cleaning member looks thicker because of attachment of a developer to a to-be-taken-up cleaning member, that is to say, a taken-up radius of the winding roller increases beyond an increased amount of a thickness of only the cleaning member, the cleaning member can be taken up by an amount which looks equal to the feed amount. Consequently, it is possible to prevent an excessive tension from being loaded on the cleaning member.

Further, in the invention, it is preferable that the fixing device further comprises developer removing means for removing a developer existent on a surface of the to-be-taken-up cleaning member provided on a periphery of the winding roller.

Further, according to the invention, the fixing device further comprises the developer removing means for removing the developer existent on the surface of the to-be-taken-up cleaning member provided on the periphery of the winding roller. The developer attached to the to-be-taken-up cleaning member is removed for cleaning by the developing removing means. By so doing, the cleaning member itself can be made in a clean state and therefore, it is made possible to enhance the accuracy of the take-up amount, and to repeatedly use the cleaning member.

Further, the invention provides an image forming apparatus for forming a print image in electrophotography, comprising the fixing device mentioned above.

Further, according to the invention, the fixing device is provided and therefore, there can be realized an image forming apparatus for forming an image for a long period of time without causing an image defect due to a hot offset.

BRIEF DESCRIPTION OF THE DRAWINGS

Other and further objects, features, and advantages of the invention will be more explicit from the following detailed description taken with reference to the drawings wherein:

FIG. 5 is a view illustrating a table data stored in a memory;

FIG. 8 is a view illustrating a table data for converting a size of a recording paper and a print ratio to a standard index value;

FIG. 9 is a view illustrating a table data for converting a size of a recording paper and a print ratio to a standard index value;

DETAILED DESCRIPTION OF THE PREFERRED EMBODIMENTS

Figure 1:
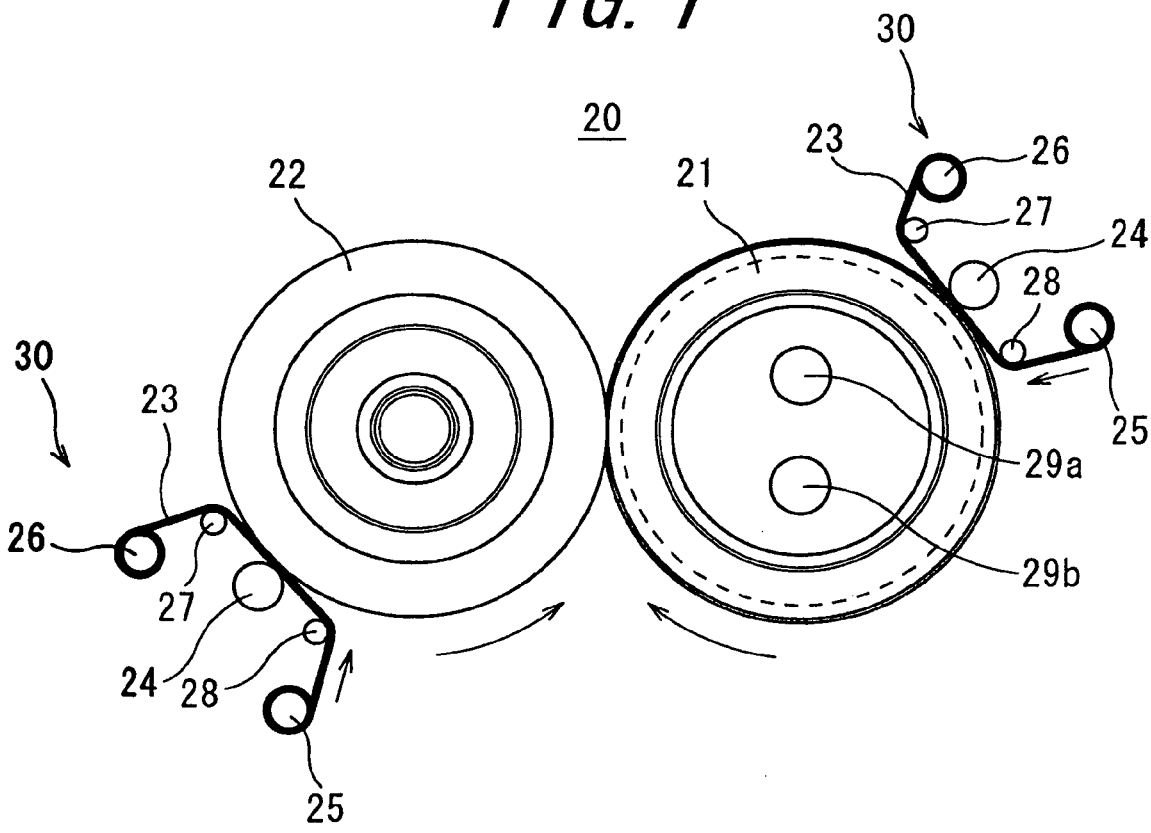
FIG. 1 is a schematic view showing a configuration of a fixing device according to a first embodiment of the invention.

Now referring to the drawings, preferred embodiments of the invention are described below.

Figure 2:
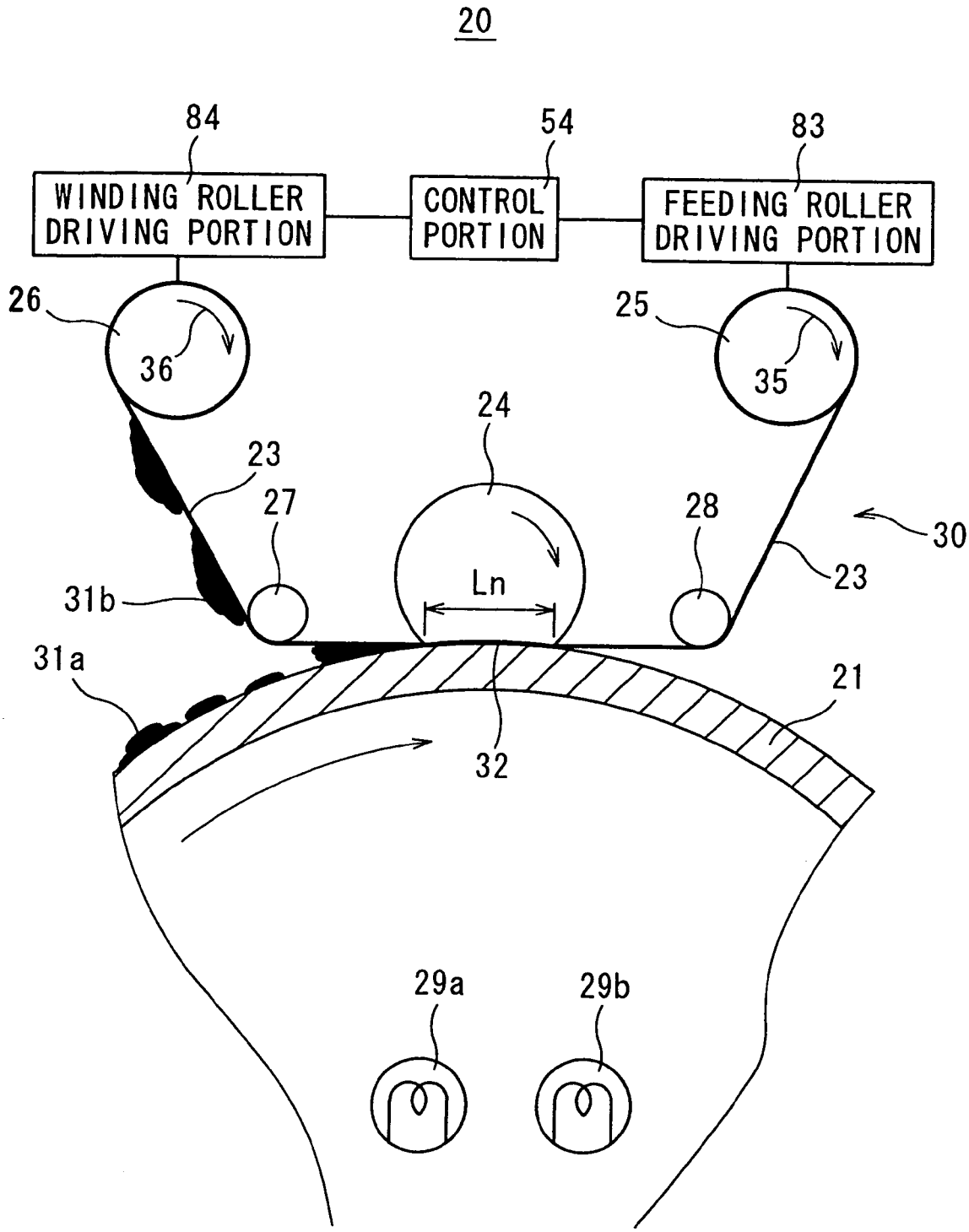
FIG. 2 is an enlarged view of the fixing device shown in FIG. 1 in the vicinity of a heating roller.

FIG. 1 is a schematic view showing a configuration of a fixing device 20 according to a first embodiment of the invention. FIG. 2 is an enlarged view of the fixing device 20 shown in FIG. 1 in the vicinity of a heating roller 21.

The fixing device 20 comprises a heating roller 21, a pressure roller 22, a belt-shaped cleaning member 23, a pressure-contact roller 24, a feeding roller 25, a winding roller 26, a feeding roller driving portion 83, a winding roller driving portion 84, a control portion 54 serving as control means, a first guide roller 27, and a second guide roller 28. The heating roller 21 and the pressure roller 22 are formed by a pair of rotators, and constitute fixing rollers. The belt-shaped cleaning member 23 is provided so as to contact the heating roller 21 and the pressure roller 22, respectively, and cleans surfaces of the fixing rollers. The pressure-contact roller 24 is provided so as to press the cleaning member 23 against the fixing roller which is in contact with the cleaning member 23, and provided so as to form a nip section 32 serving as a pressing portion. The feeding roller 25 feeds the belt-shaped cleaning member 23 which has been previously rolled up in a coil shape or a roll shape. The winding roller 26 takes up the cleaning member 23 which has been fed from the feeding roller 25 and cleaned the roller surface. The feeding roller driving portion 83 rotationally drives the feeding roller 25. The winding roller driving portion 84 rotationally drives the winding roller 26. The control portion 54 controls rotary operations of the feeding roller 25 and the winding roller 26, to be more exact, operations of the feeding roller driving portion 83 and the winding roller driving portion 84 so that a sum of a feed amount of the cleaning member 23 which is fed by the feeding roller 25 at one feeding occasion, and a take-up amount of the cleaning member 23 which is taken up by the winding roller 26 at one take-up occasion, is equal to or more than a double of a length Ln of the nip section 32 in a feeding direction of the cleaning member 23. The first guide roller 27 is provided between the pressure-contact roller 24 and the winding roller 26 so as to contact the cleaning member 23. The second guide roller 28 is provided between the feeding roller 25 and the pressure-contact roller 24 so as to contact the cleaning member 23.

The fixing device 20 is provided with various units which are similar to those provided in a heretofore known fixing device. These units include, although not shown here, a heater control power source for supplying electric power to heating heaters 29*a* and 29*b* serving as heat sources provided in the heating roller 21; a temperature sensor for detecting a temperature of the heating roller 21; pressing means for pressing the pressure roller 22 against the heating roller 21; and driving means for rotationally driving the heating roller 21 and the pressure roller 22.

The fixing device 20 is mounted, for instance, in an electrophotographic image forming apparatus. In this case, the fixing device 20 is used for fixing that the unfixed developer is fused and fixed onto the recording medium by passing the recording medium on which an image of an unfixed developer is formed, through a nip section formed by the heating roller 21 and the pressure roller 22.

Among all portions constituting the aforementioned fixing device 20, the cleaning member 23, the feeding roller 25, the pressure-contact roller 24, the winding roller 26, the feeding roller driving portion 83, the winding roller driving portion 84, and the first and second guide rollers 27 and 28 constitute fixing roller cleaning means 30 for cleaning away a developer attached to a surface of the fixing roller.

In the fixing device 20 according to the embodiment, the fixing roller cleaning means 30 are provided on both of the heating roller 21-side and the pressure roller 22-side. Since the heating roller 21 and the pressure roller 22 have the same configuration, the fixing roller cleaning means 30 provided on the heating roller 21-side will be described as a representative example of the configuration so as to omit a description of the fixing roller cleaning means 30 provided on the pressure roller 22-side.

The cleaning member 23 is a long belt-shaped windable and unwindable member. The cleaning member 23 has such a configuration that a developer 31*a* attached in a fused state to a surface of the heating roller 21 can be entered into an air layer and/or an air gap which are minute spaces, that is, the developer 31*a* can be impregnated (absorbed) into the cleaning member 23. A material having heat resistance in a temperature of approximately 200° C. which is a fixing temperature, is used for the cleaning member 23, and for instance, Nomex paper (trade name) is preferable.

The pressure-contact roller 24 has at least an outermost layer formed of an elastic material having heat resistance so as to be transformed to some extent when pressed against the heating roller 21 and form the nip section 32 between the heating roller 21 and the pressure-contact roller 24. The pressure-contact roller 24 is provided so that an axial line thereof is made to be parallel to an axial line of the heating roller 21, and the cleaning member 23 interposed between the heating roller 21 and the pressure-contact roller 24 is pressed against the surface of the heating roller 21 by the pressing means (not shown).

The feeding roller 25 is a member in a reel form. Around the feeding roller 25 is rolled up the cleaning member 23 having a predetermined length. The feeding roller 25 is connected to the feeding roller driving portion 83, and due to the feeding roller driving portion 83, configured so as to be capable of being reversibly rotated, in other words, be capable of being rotated in the both forward and reverse directions. The feeding roller driving portion 83 is configured so as to have an electric motor such as a stepping motor, whose rotational amount can be controlled with high accuracy. In the embodiment, a rotational speed is constant, and the rotational time control is carried out by an operational command from the control portion 54 so that the rotational amount (rotational angle) of the feeding roller 25 is set.

The winding roller 26 is a member in a reel form of the same sort of the feeding roller 25, and takes up the cleaning member 23 which has been fed from the feeding roller 25 so as to be pressed against the heating roller 21 by the pressure-contact roller 24, and then cleaned the developer 31*a*. The winding roller 26 is connected to the winding roller driving portion 84 and due to the winding roller driving portion 84, configured so as to be capable of being reversibly rotated, in other words, be capable of being rotated in the both forward and reverse directions. Note that the winding roller driving portion 84 is also configured in the same manner as in the feeding roller driving portion 83.

Figure 3:
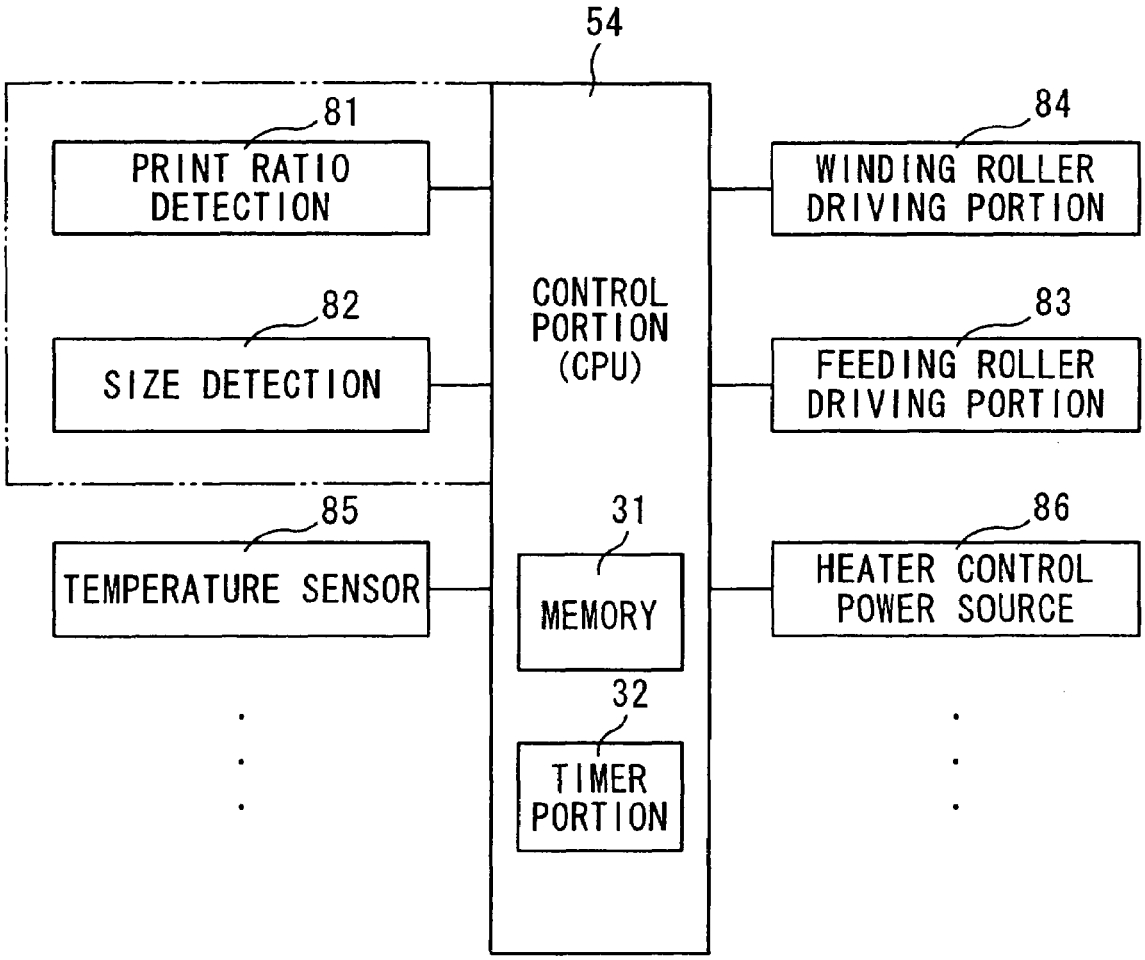
FIG. 3 is a block diagram showing an electrical structure according to a control of the fixing device in a case of being also used as a control of an image forming apparatus.

The control portion 54 serving as control means is a process circuit having a central processing unit (CPU), for instance. The control portion 54 may be configured so as to be provided as an exclusive process circuit for the fixing device 20, and may also be used as a control portion of an after-mentioned image forming apparatus 50 in which the fixing device 20 is mounted. FIG. 3 is a block diagram showing an electrical structure in a case where the fixing device 20 is mounted in the image forming apparatus 50, and the control portion 54 provided in the image forming apparatus 50 is used also as a control portion of the fixing device 20.

The control portion 54 is provided with a memory 31 and a timer portion 32. In the memory 31 is previously stored a program for controlling a whole operation of the image forming apparatus 20, and also stored is an after-mentioned table data for performing a rotationally driving control on the feeding roller 25 and the winding roller 26. In addition, the timer portion 32 measures a time for the rotational time control over the feeding roller driving portion 83 and the winding roller driving portion 84 which are connected to the control portion 54, and outputs the result.

Returning to FIGS. 1 and 2, it is preferred that the first and second guide rollers 27 and 28 are made of metal having excellent heat conductance such as iron alloy, aluminum, aluminum base alloy, copper, and copper base alloy. This is because it is possible to draw heat from the developer 31*b* in a fused or softened state, which is attached to the cleaning member 23 by a heat transfer to the first and second guide rollers 27 and 28 when the cleaning member 23 that has cleaned the surface of the heating roller 21 passes as being in contact with the guide rollers so that the developer 31*b* can be easily solidified since the first and second guide rollers 27 and 28 are made of metal having excellent heat conductance.

The first and second guide rollers 27 and 28 are disposed at such a position where the cleaning member 23 stretched between the pressure-contact roller 24 and the winding roller 26 and also between the pressure-contact roller 24 and the feeding roller 25 can be further stretched out. Preferably, the first and second guide rollers 27 and 28 are disposed at such a position that, in a cross section perpendicular to the axial line of the heating roller 21, a straight line formed by the cleaning member 23 stretched between the first guide roller 27 and the second guide roller 28 extends in a tangential direction with respect to an outer circumferential surface of the heating roller 21.

By thus disposing the first and second guide rollers 27 and 28 so that the cleaning member 23 extends in the tangential direction of the heating roller 21, tension added to the cleaning member 23 has an enhanced stability, with the result that vibration of the cleaning member 23 during the take-up operation is suppressed. Accordingly, the developer 31*b* removed by the cleaning member 23 is prevented from being detached from the cleaning member 23 and attached again to the heating roller 21 at a time of starting the take-up operation so that an excellent cleaning performance is exhibited.

An operation of the fixing roller cleaning means 30 will be simply described hereinafter. The cleaning member 23 is fed from the feeding roller 25 and stretched over the second guide roller 28. And then, the cleaning member 23 is made to pass through the nip section 32 formed between the pressure-contact roller 24 and the heating roller 21, and be stretched over the first guide roller 27 so as to be taken up by engaging a leading end thereof with the winding roller 26.

In a state where some tension is added to the cleaning member 23, a feeding operation of the feeding roller 25 and a take-up operation of the winding roller 26 are brought to a halt. In a state where the cleaning member 23 rests still, the heating roller 21 carries out rotary operation with the result that the surface of the heating roller 21 and the cleaning member 23 slidingly scrub each other and then, the cleaning member 23 cleans the surface of the heating roller 21. When the developer 31*a* has been cleaned away to some extent, the cleaning member 23 is fed in an arrow sign 35 direction from the feeding roller 25, and the winding roller 26 takes up the cleaning member 23 in an arrow sign 36 direction. In other words, the feeding roller 25 and the winding roller 26 are intermittently rotated.

In the intermittent rotary drive, the control portion 54 controls the rotary operations of the feeding roller 25 and the winding roller 26 so that the sum of the feed amount of the cleaning member 23 which is fed by the feeding roller 25 at one feeding occasion, and the take-up amount of the cleaning member 23 which is taken up by the winding roller 26 at one take-up occasion, is equal to or more than a double of the length Ln of the nip section 32 in a circumferential direction of the pressure-contact roller 24. Here, the feed amount and take-up amount of the cleaning member 23 indicate lengths of the cleaning member 23 in a fed direction and in a taken-up direction.

In the fixing device of the invention, the sum of the feed amount and the take-up amount at one feeding/take-up occasion, is equal to or more than a double of the length Ln of the nip section 32, and the feed amount and the take-up amount are controlled so as to be basically equal. Consequently, the feed amount and the take-up amount are respectively equal to or more than the length Ln and therefore, it is possible to reliably feed an unused portion of the cleaning member 23 to the nip section 32 at every one feeding/take-up occasion. Consequently, a cleaning performance by the cleaning member 23 can be reliably recovered.

The control portion 54 controls the feeding roller 25 and the winding roller 26 with respect to the length of rotational time and thereby, realizing the control for setting the feed amount due to the feeding roller 25 and the take-up amount due to the winding roller 26 to be equal to or more than the nip section length Ln, respectively.

Figure 4A:
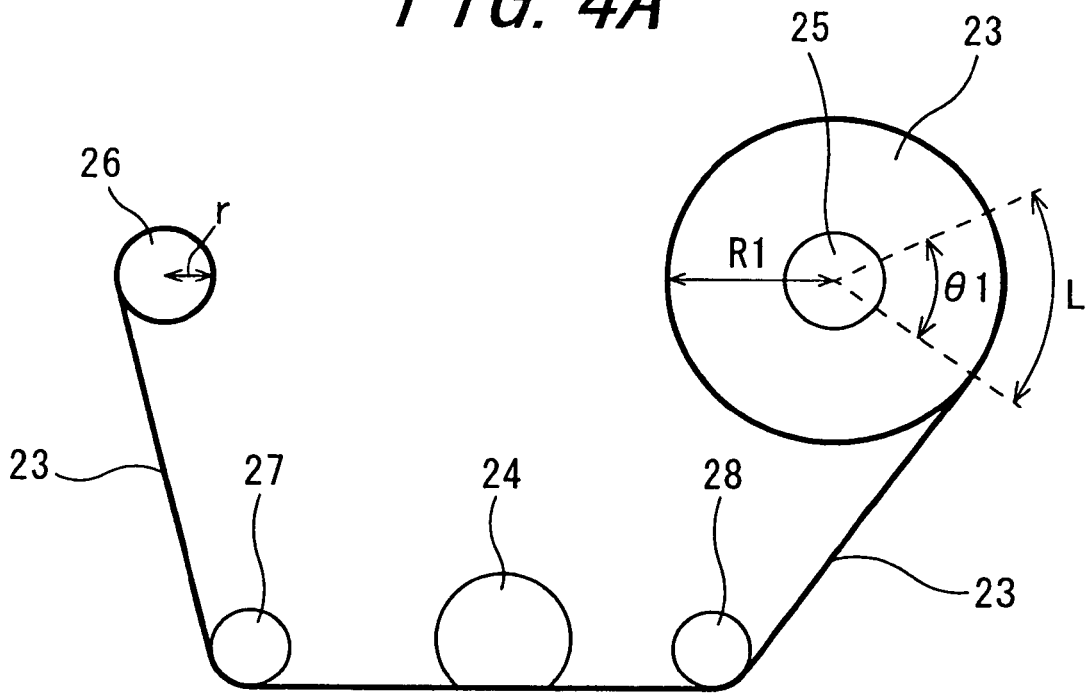
FIGS. 4A and 4B are views for explaining a general outline of a rotational time control over a feeding roller and a winding roller due to a control portion.
Figure 4B:
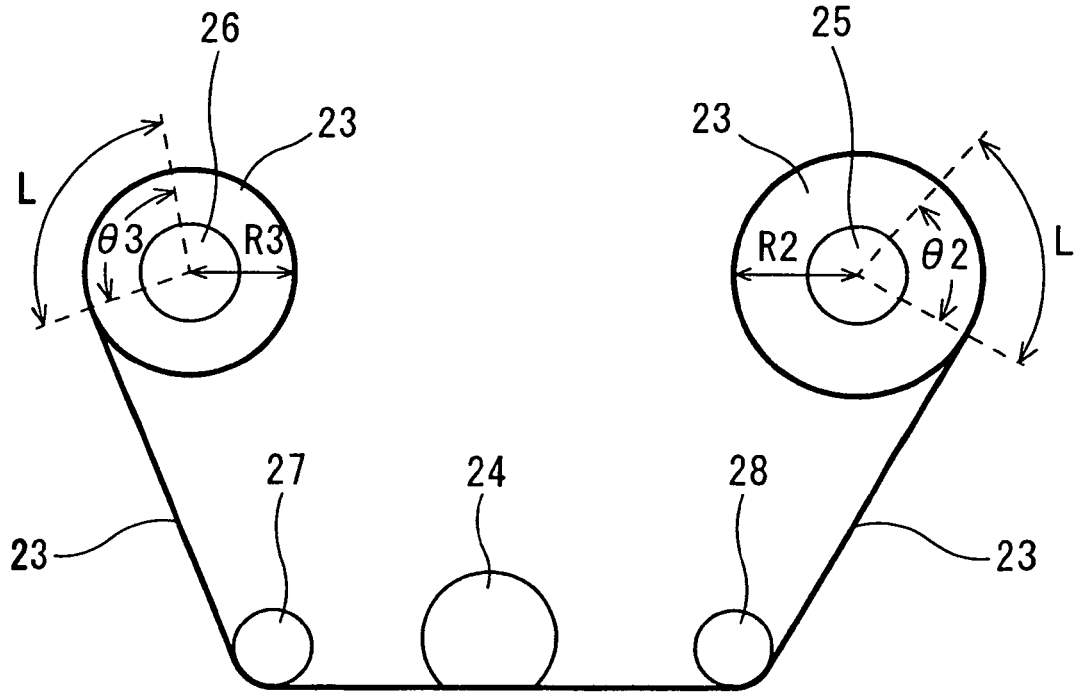

FIGS. 4A and 4B are views for explaining a general outline of a rotational time control over the feeding roller 25 and the winding roller 26 due to the control portion 54. Hereinafter will be described the rotational time controls over the feeding roller 25 and the winding roller 26 due to the control portion 54 with reference to FIGS. 4A and 4B.

A radius r of the feeding roller 25 and the winding roller 26 which are provided in the fixing device 20 is assumed to be constant at any time. A radius of the feeding roller 25 in an initial state, that is to say, a radius of the feeding roller 25 on which the cleaning member 23 in an unused state has been rolled up, is indicated by R1. The same cleaning member 23 is used at any time, and a thickness of the cleaning member 23 is indicated by t.

On such a setting, the feed amount and the take-up amount at one occasion are respectively indicated by L ($\geqq$Ln). In this case, in the initial state such as a case where the feeding roller 25 having the cleaning member 23 rolled up thereon has been replaced, for instance, a rotational angle θ1 of the feeding roller 25, which is necessary for feeding a feed amount L at a first (n=1) feeding/take-up occasion, is given by a formula

[$\theta 1=360°\times L/(2\pi R1)$]. A rotational angle θ (not shown) of the winding roller 26, which is necessary for taking up a take-up amount L, is given by a formula [$\theta=360°\times L/(2\pi r)$].

For instance, a rotational angle θ2 of the feeding roller 25 and a rotational angle θ3 of the winding roller 26 at a given n time occasion as shown in FIG. 4B can be set as a function of the number n of feeding/take-up executions.

On the condition that the rotational angle θ1 of the feeding roller 25 in the initial state satisfies θ1=60°, the feeding/take-up operations are executed for n=6 times and thereby, the feeding roller 25 goes into a 360-degree roll so that only one roll amount of the cleaning member 23 is fed and therefore, the radius of the feeding roller 25 is made to be (R1−t). On the other hand, on the winding roller 26-side, the radius of the winding roller 26 increases to [$r+t\cdot 2\pi R1/(2\pi r)$].

Likewise, it is also possible to obtain a radius R2 of the feeding roller 25 at a given n time occasion as a function f (n) of the number n of the feeding/take-up executions. A radius R3 of the winding roller 26 can also be obtained as a function F (n) of the number n of the feeding/take-up executions. The radius R2 of the feeding roller 25 and the radius R3 of the winding roller 26 are thus obtained. By so doing, the take-up amount L and the rotational angle θ2 which is necessary for feeding/taking-up the feed amount L respectively, is given by [$360°\times L/(2\pi R2)$], while the rotational angle θ3 is given by [$360°\times L/(2\pi R3)$]. Since the radiuses R2 and R3 are respectively given as functions of the number n of the feeding/take-up executions as described above, the rotational angles θ2 and θ3 are also obtained as functions of n.

In the fixing device 20, the rotational speed of the electric motor which constitutes the feeding roller driving portion 83 and the winding roller driving portion 84, is made to be constant, and the control is carried out by the control portion 54 with respect to the length of rotational time in accordance with a timing due to the timer portion 32, so that the feeding roller 25 and the winding roller 26 have desired rotational angles θ2 and θ3, respectively. The above-described table data stored in the memory 31 relates to the number n of the executions, the rotational angle, and a length of rotational time required for rotating the feeding roller 25 and the winding roller 26 by only the angle, with respect to each of the feeding roller 25 and the winding roller 26.

FIG. 5 is a view illustrating the table data stored in the memory 31. In FIG. 5 is illustrated a table data concerning a case of having a standard diameter r=6 mm of the feeding roller 25 and the winding roller 26, a rolled-up diameter R1=20 mm of the feeding roller 25 in the initial state, the nip width Ln=10 mm, and the feed amount and take-up amount=10.5 mm.

At a first time of the execution, namely at $n_1$ time of the execution, the rotational angle of the feeding roller 25 is 60° and a length of rotation driving time thereof is 1.0 second while the rotational angle of the winding roller 26 is 200° and the length of rotation driving time thereof is 3.33 seconds. In the same manner, at $n_m$ time of the execution when the rolled-up diameters of the feeding roller 25 and the winding roller 26 are made to be substantially equal, the rotational angles of both of the feeding roller 25 and the winding roller 26 are 93°, and the lengths of the rotation driving time thereof are 1.55 seconds. At $n_e$ time of the execution in a state where the feeding roller 25 has fed almost all the cleaning member 23, the rotational angle of the feeding roller 25 is 200° and the length of rotation driving time thereof is 3.33 seconds while the rotational angle of the winding roller 26 is 60° and the length of rotation driving time thereof is 1.0 second.

The length of rotational time shown in FIG. 5 is just an illustration. It is needles to say that the length of rotational time changes depending on the rotational speed which is set on the electric motor used as the feeding roller driving portion 83 and the winding roller driving portion 84. In addition, the rotational angles of the feeding roller 25 and the winding roller 26 can be controlled by making the lengths of the rotational time of the feeding roller driving portion and the winding roller driving portion constant, and changing the rotational speed thereof. However, the rotational time control is preferably carried out as in the case of the fixing device 20 of the embodiment, because the control over the rotational speed is generally carried out by changing a current value which flows through the electric motor, but this control has lower control accuracy compared to the case where the rotational time control is carried out by making the rotational speed constant.

Illustrated above is the control over the length of rotation driving time in a case where the fed cleaning member 23 has the same thickness as the cleaning member 23 which has cleaned the fixing roller and is taken up. In a real operation of the fixing device 20, the developer 31*b* may be attached to the cleaning member 23 which has cleaned the fixing roller and is taken up, so that an apparent thickness of the cleaning member 23 may increase.

When the apparent thickness of the cleaning member 23 increases, the taken-up radius of the winding roller 26 becomes larger with more than the increased amount of only the thickness of the cleaning member 23, compared to the taken-up radius in a case where the cleaning member 23 continues to be taken up in a state where a thickness t of the cleaning member 23 does not change. Consequently, when the winding roller 26 is made to rotate by the rotational angle obtained in accordance with the table data as shown in FIG. 5, for instance, the cleaning member 23 is taken up more than the feed amount due to the feeding roller 25 and therefore, an excessive tension is loaded on the cleaning member 23. This situation is not favorable.

In order to prevent such an excessive tension from being loaded on the cleaning member 23, the following modification is allowable in the invention. The control portion 54 controls the rotary operation of the winding roller 26 so that the length of the rotational time of the winding roller 26 is shorter than that of rotational time which is required for taking up the cleaning member 23 at one take-up occasion by an amount which is equal to the feed amount of the cleaning member 23 fed by the feeding roller 25 at one feeding occasion.

By so doing, it is possible to take up the cleaning member 23 by the amount which looks equal to the feed amount, even in a case where the developer is attached to the to-be-taken-up cleaning member 23 so that the apparent thickness of the cleaning member 23 increases, in other words, in a case where the taken-up radius of the winding roller 26 increases more than the increased amount of the thickness of the cleaning member 23. Consequently, it is possible to prevent the excessive tension from being loaded on the cleaning member 23.

The control for reducing the length of rotational time of the winding roller 26 can be realized as follows. On the basis of a type of the to-be-used developer, a predetermined fixing temperature, and the like, the increased amount of the apparent thickness of the cleaning member 23 due to the attachment of the developer is experientially obtained and then, for instance, a table data which is similar to the table data in FIG. 5 is previously drawn up.

Moreover, it is also possible to prevent the apparent thickness of the cleaning member 23 from increasing by removing the developer 31*b* attached to the to-be-taken-up cleaning member 23, instead of the control for reducing the length of rotational time of the winding roller 26.

Figure 6:
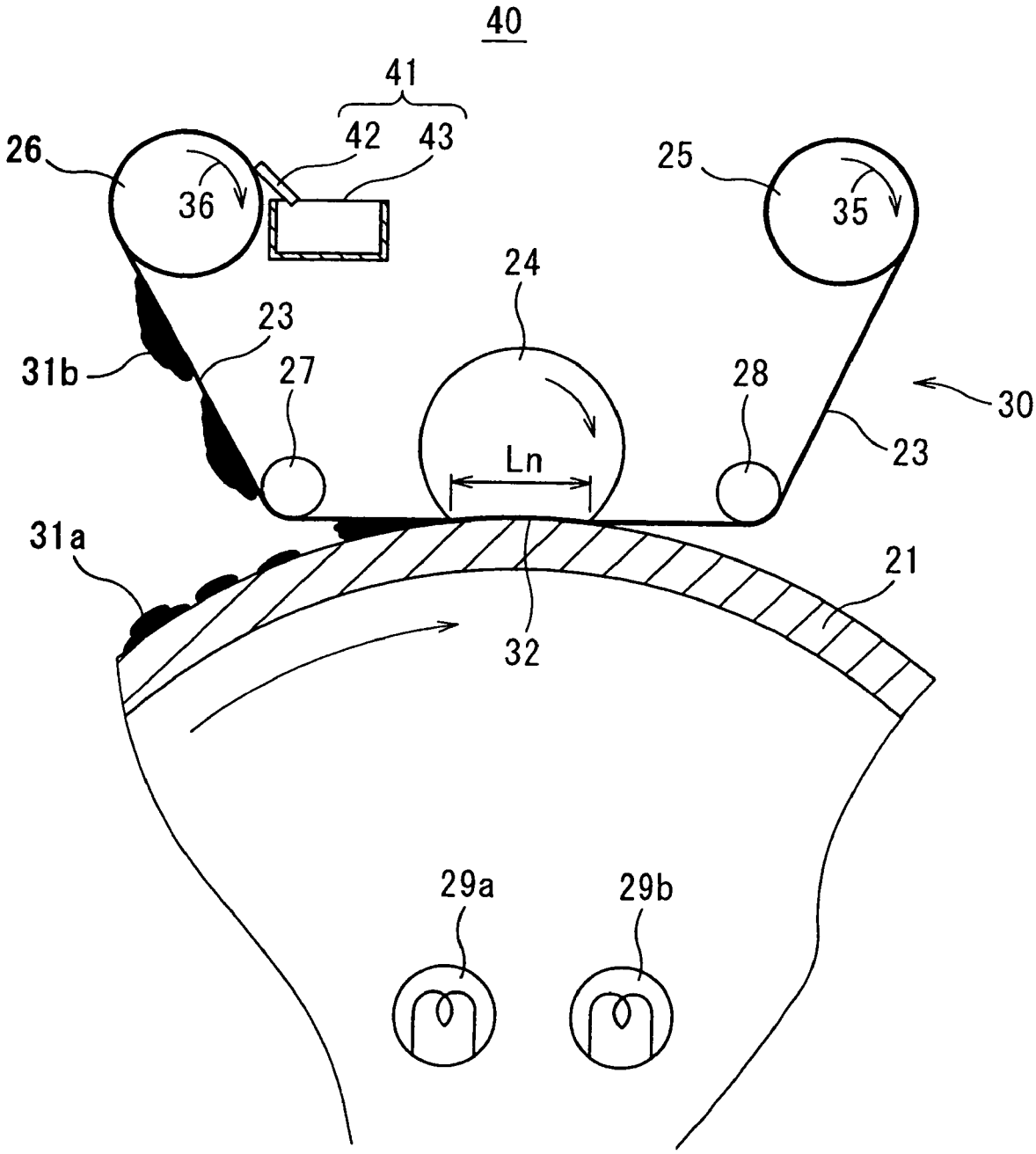
FIG. 6 is a schematic view showing a configuration of a fixing device according to a second embodiment of the invention.

FIG. 6 is a schematic view showing a configuration of a fixing device 40 according to a second embodiment of the invention. The fixing device 40 according to the embodiment is similar to the fixing device 20 according to the first embodiment of the invention, so that corresponding components will be denoted by the same reference numerals and descriptions thereof will be omitted.

In the fixing device 40, it should be noted that on a periphery of the winding roller 26 of the fixing roller cleaning means 30 is provided developer removing means 41 for removing the developer 31*b* existent on the surface of the to-be-taken-up cleaning member 23.

The developer removing means 41 comprises a blade member 42 provided so that an end thereof contacts the cleaning member 23 to be taken up by the winding roller 26, and a collection container 43 for collecting the developer removed from the surface of the cleaning member 23 by the blade member 42.

The blade member 42 is a platy member formed of metal, resin, or the like having elasticity, and extends in a direction of an axial line of the winding roller 26. One end of the blade member 42 in a direction perpendicular to the axial line contacts the cleaning member 23 to be taken up by the winding roller 26, and the other end thereof is mounted in a main body of the fixing device 40. The collection container 43 is a hollow container having a schematic rectangular parallelepiped shape, in which an opening is formed over all sides. The collection container 43 is mounted in the main body of the fixing device 40 in such a configuration that the developer removed from the surface of the cleaning member 23 by the blade member 42 is collected through the opening.

According to the fixing device 40 of the embodiment, the developer 31*b* in a fused state, which is removed from the surface of the heating roller 21 (as well as the pressure roller 22) by the cleaning member 23 is easily solidified by the heat transfer loss to the first guide roller 27 since the cleaning member 23 is taken up by slidingly scrubbing the first guide roller 27 when the cleaning member 23 is taken up by the winding roller 26. The developer removing means 41 cleans the developer 31*b* in a solidified state away from the cleaning member 23 and therefore, the removal can be carried out with extreme ease. In this manner, the cleaning member 23 taken up by the winding roller 26 has the attached developer 31*b* removed by the developer removing means 41 and therefore, the thickness of the cleaning member 23 is maintained as t.

Consequently, the winding roller 26 can form a taken-up shape of the to-be-taken-up cleaning member 23 into a precise cylindrical shape which can be calculated by the thickness t of the cleaning member 23. In other words, when the cleaning member 23 is taken up without having the developer 31*b* removed from the surface thereof, the developer 31*b* is wound into the winding roller 26. By so doing, the apparent thickness of the cleaning member 23 increases, and the taken-up radius of the winding roller 26 becomes larger more than the increased amount of only the thickness of the cleaning member 23. However, such a problem can be solved by providing the developer removing means 41. The control over the length of the rotation driving time can be carried out in accordance with the above-described table data as shown in FIG. 5.

Figure 7:
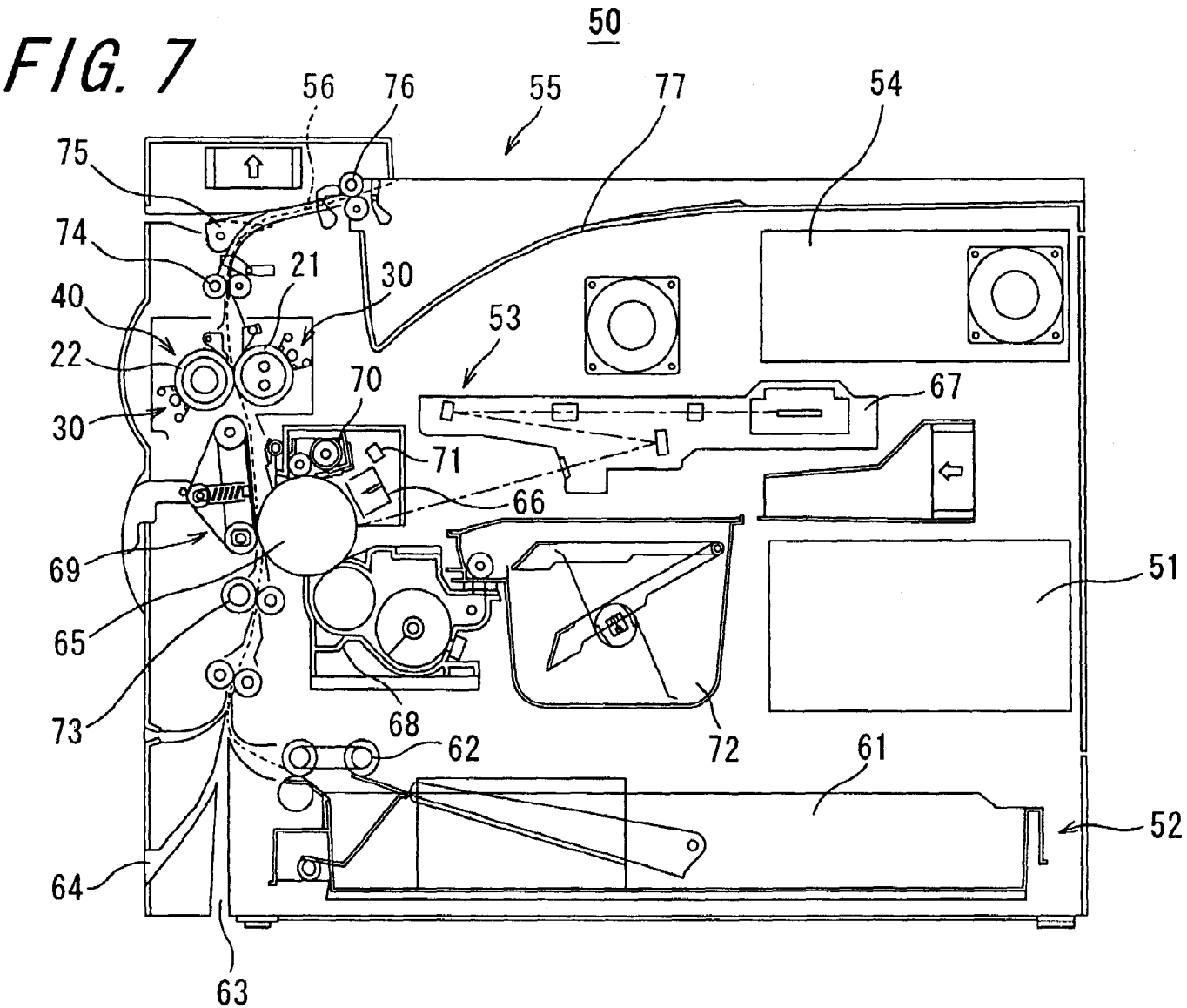
FIG. 7 is a schematic view showing a configuration of an image forming apparatus according to a third embodiment of the invention.

FIG. 7 is a schematic view showing a configuration of an image forming apparatus 50 according to a third embodiment of the invention. The image forming apparatus 50 is provided with the fixing device 40 according to the second embodiment of the invention. The image forming apparatus 50 illustrated in the embodiment is an electrophotographic printer. Note that an illustration of the developer removing means 41 will be omitted since the fixing device 40 is shown small in FIG. 7.

The image forming apparatus 50 largely comprises a power source portion 51 for supplying electric power to various units of the image forming apparatus 50; a sheet supply portion 52 for supplying a recording paper serving as a recording medium on which an image is formed and recorded; a image forming unit 53; the fixing device 40; the control portion 54 for receiving image information from an external equipment and controlling a whole operation of the image forming apparatus 50; a discharge portion 55; and a sheet conveying system 56 for controlling conveyance of a recording paper from the sheet supply portion 52 to the discharge portion 55.

The sheet supply portion 52 is provided with a supply tray 61 for housing a recording paper, and a pickup roller 62 for feeding the recording paper housed in the supply tray 61 sheet by sheet to the sheet conveying system 56. Note that under the sheet supply portion 52 and under a main body of the image forming apparatus, a sheet supply unit including a multistage sheet tray, a high-capacity sheet supply unit capable of housing sheets in large quantity, or the like may be disposed as a peripheral equipment. In a case where such a peripheral equipment is provided, the recording paper from the peripheral equipment is supplied from a sheet receiving portion 63 and an expansive sheet receiving portion 64 to the main body of the image forming apparatus.

The image forming unit 53 is disposed above the sheet supply portion 52. The image forming unit 53 comprises a photoreceptor 65, and a charging unit 66, a light scanning unit 67, a developing unit 68, a transfer unit 69, a cleaning unit 70, and an electricity removing lamp 71, which are disposed along an outer circumferential surface of the photoreceptor 65.

The charging unit 66 uniformly charges a surface of the photoreceptor 65 which has not yet been exposed to light by the light scanning unit 67. The light scanning unit 67 scans the uniformly charged photoreceptor 65 with light in accordance with the image information so as to form an electrostatic latent image. The developing unit 68 supplies the developer inside a developer supply container 72 to the electrostatic latent image formed on the surface of the photoreceptor 65 so as to form a visualized developer image.

The transfer unit 69 transfers the developer image on the recording paper which is supplied in arranged timing so that a registration roller 73 provided upstream of the photoreceptor 65 in the sheet conveying system 56 registers the recording paper at a developer image forming position on the photoreceptor 65.

The cleaning unit 70 removes a residual developer which has not been transferred on the recording paper and remains on the photoreceptor 65. The electricity removing lamp 71 removes charges on the surface of the photoreceptor 65, thereby preparing for next uniform charging of the charging unit 66.

The fixing device 40 is provided downstream of the transfer unit 69 in the sheet conveying system 56 so that the developer image transferred on the recording paper is fixed so as to form a solid recording image.

A conveyance roller 74 and a switching gate 75 are disposed further downstream of the fixing device 40 in the sheet conveying system 56. The conveyance roller 74 conveys the recording paper which has passed through the fixing device 40, to further downstream in the sheet conveying system 56. The switching gate 75 optionally opens a conveyance path which is suitable for the recording paper to be conveyed by the conveyance roller 74, to be conveyed. The discharge portion 55 comprises a discharge roller 76 provided further downstream of the switching gate 75 in the sheet conveying system 56, and a discharge tray 77 for placing the recording paper discharged outward the main body of the image forming apparatus by the discharge roller 76.

The control portion 54 serves also as a control portion of the image forming apparatus 50 and a control portion of the fixing device 40 as described above. The control portion 54 has accessories such as a memory 31 serving as storing means, a timer portion 32 and in addition, an interface for receiving image information from an external equipment (not shown). The control portion 54 controls a whole operation of the image forming apparatus 50, which operation includes the operation of the fixing device 40. The memory 31 of the control portion 54 previously stores a program and an operational control condition for controlling the whole operation of the image forming apparatus 50.

An image forming operation in the image forming apparatus 50 will be described hereinafter. For instance, image information produced by external equipments such as a personal computer is given to the control portion 54 via the interface and then, the image information is stored in the memory 31 of the control portion 54. The control portion 54 reads out the image information from the memory 31 and performs image processing such as conversion process. And then, the control portion 54 feeds to the light scanning unit 67 the image information on which the image processing has been performed. The light scanning unit 67 irradiates the surface of the photoreceptor 65, which has been charged by the charging unit 66 so as to have a uniform electric potential, with light in accordance with the image information so as to form an electrostatic latent image.

The electrostatic latent image formed on the surface of the photoreceptor 65 is developed by the developing unit 68 so as to be a developer image. The transfer unit 69 transfers the developer image formed on the photoreceptor 65 onto the recording paper which has been supplied from the sheet supply portion 52 and fed in arranged timing by the registration roller 73. The recording paper, on which the developer image has been transferred, is fixed by the fixing device 20 and then discharged to the discharge tray 77 by the discharge roller 76.

On the other hand, the photoreceptor 65 from which the developer image is detached by the transfer unit 69, has the residual developer cleaned by the cleaning unit 70 and the electricity removed by the electricity removing lamp 71. The image forming apparatus 50 can repeat the aforementioned image forming operation.

The fixing device 40 mounted on the image forming apparatus 50 operates so that the developer on the recording paper is made to be fused and softened so as to be fixed on the recording paper. However, the developer is attached to the fixing roller by repeating a fixing operation on a plurality of the recording papers and therefore, the fixing roller is cleaned by the cleaning member 23 of the fixing roller cleaning means 30 as described above. Furthermore, attributable to the cleaning, in a gap between the cleaning member 23 and the fixing roller is accumulated to some extent the developer removed from the fixing roller and then, the feeding roller 25 and the winding roller 26 are made to rotate in the forward directions (arrow sign 35 and 36 directions) by the above-described time control. The cleaning member 23 is fed and taken up by the amount which is equal to the feed amount and take-up amount predetermined by each length of the rotational time of the feeding roller 25 and the winding roller 26, so that a clean portion of the cleaning member 23 is newly made to slidingly scrub the fixing roller. By so doing, the cleaning member 23 is made to recover a cleaning capability thereof so as to continue to clean the fixing roller for a long period of time. In this manner, the operation that the feeding roller 25 and the winding roller 26 are made to rotate by the time control is an intermittent rotary operation.

A timing that the feeding roller 25 and the winding roller 26 start the intermittent rotary operation, namely a timing that the feeding and take-up operations are intermittently carried out, depends on an amount of the developer accumulating in the gap between the cleaning member 23 and the fixing roller. Since the amount of the accumulating developer is substantially proportional to an amount of the developer on the recording paper which passes through the fixing device 40 and is fixed, the amount of the accumulating developer can be obtained by a size of the recording paper and a print ratio with respect to the recording paper.

Consequently, in the image forming apparatus 50 in which the fixing device 40 is mounted, the timing of taking up the cleaning member 23 of the fixing device 40 is determined by the size of the recording paper and the print ratio with respect to the recording paper as indexes so that the feeding roller 25 and the winding roller 26 are made to rotate by the time control.

Returning to FIG. 3, the intermittent rotary operation of the fixing device 40 mounted in the image forming apparatus 50 will be described. FIG. 3 shows also an electrical structure according to the intermittent rotary operation of the fixing device 40. The image forming apparatus 50 provided with the fixing device 40, comprises print ratio detecting means 81 for detecting the print ratio of to-be-formed print image, and size detecting means 82 for detecting the size of the recording paper on which the print image is recorded. The control portion 54 responds to detected outputs of the print ratio detecting means 81 and the size detecting means 82, and controls the winding roller 26 and the feeding roller 25 provided in the fixing device 40, in connection with a timing of starting the rotary operation of the intermittent rotation, and the length of rotational time. Note that to the control portion 54 are connected various input systems and output systems other than various units shown in FIG. 3, for operating the image forming apparatus 50, but these systems are omitted in order to avoid intricacy of the drawing.

In the image forming apparatus 50, since the image information is given to the control portion 54 as digital data from external equipments such as a personal computer, for instance, and the print ratio of the image is included in the image information, the control portion 54 which has received the image information can detect the print ratio of the image information. Accordingly, in the embodiment, the control portion 54 serves as well as the print ratio detecting means 81.

In addition, when the image information together with the print command is given from the personal computer to the control portion 54, the information according to the print command includes the size of the recording paper on which an image should be formed. Consequently, the size of the recording paper can be detected likewise by the control portion 54. Moreover, when the image information once stored in the memory 31 of the control portion 54 is read out on the image forming apparatus 50-side so as to form an image, for instance when an operator inputs a print request from an operating portion of the image forming apparatus 50 so as to form an image, the to-be-inputted print request information includes the size of the recording paper and therefore, the control portion 54 for receiving the print request information can detect the size of the recording paper. Accordingly, in the embodiment, the control portion 54 serves as well as the size detecting means 82.

On the basis of the print ratio of the image information and the size of the recording paper on which an image should be formed, being detected by the print ratio detecting means 81 and the size detecting means 82 as which the control portion 54 serves as well, the control portion 54 determines the timing of starting the rotary operations of the feeding roller 25 and the winding roller 26, and the length of time for rotationally driving the feeding roller 25 and the winding roller 26 based on the above-described table data shown in FIG. 5 and then, outputs a command for the rotary operation with respect to the feeding roller driving portion 83 and the winding roller driving portion 84 in accordance with a measured time outputted from the timer portion 32.

Note that the electrical structure according to the operation of the fixing device 40 in the image forming apparatus 50 includes a temperature sensor 85 provided on the fixing roller, and a heater control power source 86 for turning on/off an electric power supply with respect to the heating heaters 29*a* and 29*b* of the heating roller 21. A detected result of a temperature of the fixing roller due to the temperature sensor 85 is inputted to the control portion 54 so that the control portion 54 controls an operation of the heater control power source 86, thereby setting the temperature of the fixing roller to a desired temperature.

Hereinafter, there is illustrated one method of determining the timing of starting the rotary operation due to the control portion 54. In the image forming apparatus 50 of the embodiment, the timing of starting the rotary operation of the feeding roller 25 and the winding roller 26 is determined by the print ratio and the size of the recording paper to be printed at the print ratio as indexes.

As described above, the developer amount accumulating on the cleaning member 23 which is in contact with the fixing roller is substantially proportional to the developer amount on the recording paper which passes through the fixing device 40 and is fixed. Accordingly, in a case where the size of the recording paper is the same, the developer is accumulated faster with a higher print ratio. Moreover, in a case where the print ratio is the same, the developer is accumulated faster with a larger recording paper.

Consequently, the size of the recording paper and the print ratio with respect to the recording paper are multiplied by a coefficient for weighting, and converted to a case of being printed on the recording paper of a standard size at a standard print ratio, with the result that the obtained value can be recognized as an index in order to know an accumulated amount of the developer, in other words, a soiling degree of the cleaning member 23. This index value is accumulated, and when this integrated value exceeds a predetermined standard value as a cleaning limitation of the cleaning member 23, a clean portion of the cleaning member 23 can be newly made to contact the fixing roller by feeding and taking up the cleaning member 23 so as to recover a cleaning capability by taking up the cleaning member 23.

In the image forming apparatus 50, in the memory 31 provided in the control portion 54 is previously stored a table data for converting the size of the recording paper and the print ratio with respect to the recording paper to the case of being printed on the recording paper of the standard size at the standard print ratio. The control portion 54 responds to the size of the recording paper detected by the size detecting means 82 and the print ratio detected by the print ratio detecting means 81, and obtains a standard index value based on the aforementioned table data. Sequentially, the control portion 54 obtains an integrated value by accumulating the standard index value and furthermore, compares the integrated value to a predetermined standard value. When the integrated value becomes equal to or more than the standard value, the control portion 54 outputs an operational command to the feeding roller driving portion 83 and the winding roller driving portion 84 and then, feeds and takes up the cleaning member 23 by driving the feeding roller 25 and the winding roller 26 to rotate so as to be controlled in connection with the length of time.

FIGS. 8 and 9 are views illustrating table data for converting the size of the recording paper and the print ratio to the standard index value. In the image forming apparatus 50 of the embodiment is standardized on a case where a paper of A4 size prescribed in Japanese Industrial Standards (JIS) P0138 is widthwise conveyed and fixed.

In FIG. 8 is shown a conversion ratio for converting the prints on papers of various sizes to a case of an A4 size widthwise conveyance serving as a standard index. In FIG. 8 is shown a conversion ratio for converting the converted value to the A4 size widthwise conveyance, to a case of a print ratio of 5% or less to be selected as a standard, further in the A4 size widthwise conveyance.

A calculation of the integrated value in the control portion 54 will be illustrated hereinbelow. For instance, when the recording paper passing through the fixing device 40 just has a print ratio of 8 to 12% in a size A3, this is converted to the standard index value which is a print ratio of 5% or less in the A4 size widthwise conveyance. First, a paper of A3 size is converted to two sheets of the recording paper of the print ratio of 8 to 12% in the A4 widthwise conveyance by accumulating the conversion rate 2.00 based on the table data in FIG. 8. Next, the print ratio of 8 to 12% in the A4 widthwise conveyance is converted to four sheets of the recording paper by accumulating the conversion rate 2.00 for converting to the print ratio of 5% or less in the A4 widthwise conveyance based on the table data in FIG. 9. Thus, when one sheet of the recording paper of the print ratio of 8 to 12% in the A3 is fixed, the recording paper is converted to the four sheets of the recording paper of the print ratio of 5% or less in the A4 widthwise conveyance serving as the standard index value.

Thus, every time one sheet of the recording paper is fixed by the fixing device 40, the control portion 54 converts the recording paper to the standard index value and performs a calculation of accumulating the converted value so as to obtain the integrated value. When this integrated value becomes the standard value or more, the control portion 54 outputs the operational command to the feeding roller driving portion 83 and the winding roller driving portion 84 so that the feeding roller 25 and the winding roller 26 respectively carry out the feeding and take-up operations of the cleaning member 23.

Figure 10:
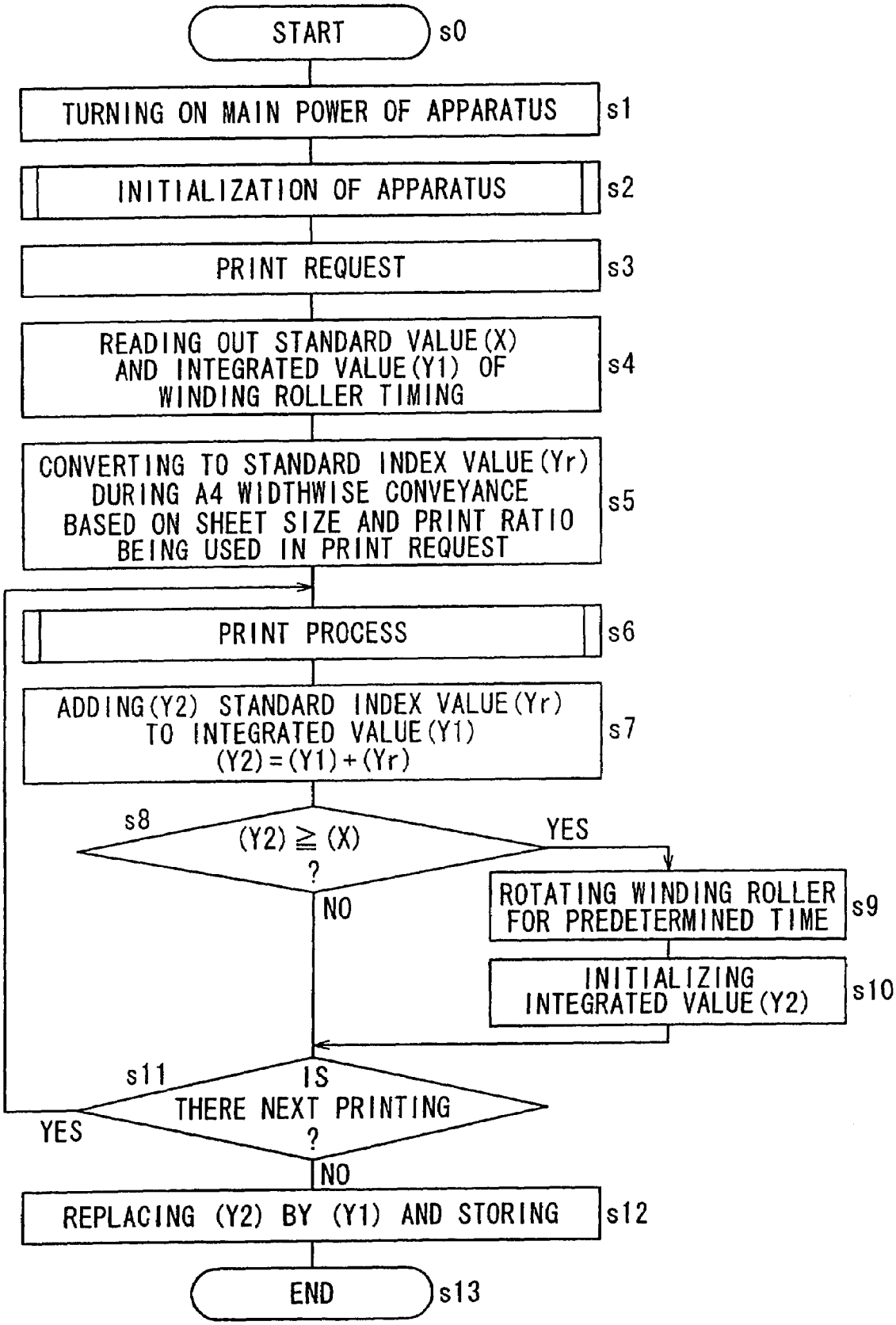
FIG. 10 is a flow chart for explaining feeding and take-up operations of a cleaning member.
Figure 11:
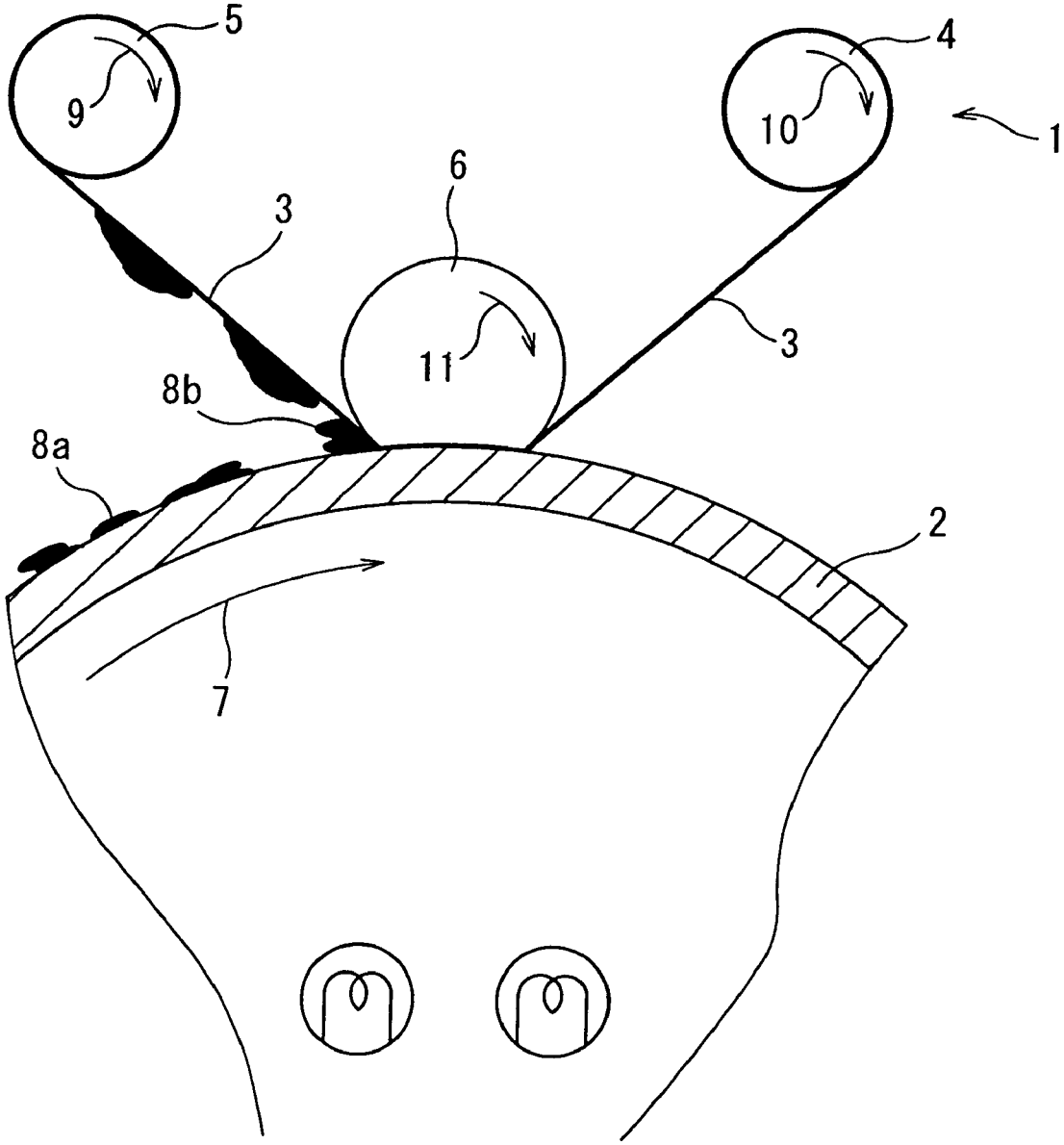
FIG. 11 PRIOR ART
FIG. 11 is a schematic view showing a configuration of roller cleaning means provided in a related art fixing device.

FIG. 10 is a flow chart for explaining the feeding and take-up operations of the cleaning member 23. With reference to the FIG. 10, the feeding and take-up operations of the cleaning member 23 will be described.

A start of step s0 is a state where, for instance, image information previously created by a personal computer or the like is given to the image forming apparatus 50, and stored in the memory 31 of the control portion 54 in the image forming apparatus, and then the print request is inputted to the image forming apparatus 50 with the result that image read out from the memory 31 can be printed and fixed.

At step s1, a main power of the image forming apparatus 50 is turned on by the operator. At step s2, the control portion 54 initializes the image forming apparatus 50. Here, the initialization of the image forming apparatus 50 indicates a set of preliminary operation for the image forming apparatus 50 to perform image formation. The preliminary operation includes removal of residual potential of the photoreceptor 65, temperature rising of the fixing roller up to a prescribed temperature, and the like. At step s3, a print request is inputted by the operator from an input portion provided in the image forming apparatus 50. This print request includes a designation of the to-be-printed image information among the image information stored inside the memory 31, a designation of the size of the recording paper for recording the image information, and the number of printing sheets.

At step s4, the control portion 54 reads out from the memory 31 a standard value (X) which is predetermined as a cleaning limitation of the cleaning member 23 and previously stored in the memory 31, and an integrated value (Y1) obtained by accumulating the value which is obtained by converting to the standard index value during a previous print operation. At step s5, in response to the designation of the to-be-printed image information and the designation of the size of the recording paper for recording the image information, the control portion 54 serving as well as the print ratio detecting means 81 and the size detecting means 82, detects the print ratio from the designated image information, and detects the size of the recording paper. Further, the control portion 54 responds to the detected print ratio and recording paper size, so as to calculate the standard index value (Yr) which is converted to A4 widthwise conveyance and the print request 5% or less regarding the to-be-printed image information based on the table data shown in FIGS. 8 and 9.

At step s6, a print process is executed in the image forming unit 53 of the image forming apparatus 50, and a fixing process is executed in the fixing device 40. At step s7, the control portion 54 obtains the integrated value (Y2) by adding the standard index value (Yr) to the integrated value (Y1), that is (Y2)=(Y1)+(Yr).

At step s8, the control portion 54 compares the integrated value (Y2) and the standard value (X). When the integrated value (Y2) is equal to or more than the standard value (X), the operation proceeds to step s9. When the integrated value (Y2) is less than the standard value (X), the operation proceeds to step s11.

At step s9, the integrated value (Y2) is equal to or more than the standard value (X) predetermined as the cleaning limitation and therefore, the control portion 54 outputs the operational command to the feeding roller driving portion 83 and the winding roller driving portion 84 so that the feeding roller 25 and the winding roller 26 are made to rotate in the forward directions 35 and 36 by the time control in accordance with the above-described table data shown in FIG. 5, for instance. Here, the length of the time that the feeding roller 25 and the winding roller 26 respectively rotate satisfies a condition that the feed amount of the feeing roller 25 is L (≧the nip section length Ln) and the take-up amount of the winding roller 26 is L (≧the nip section length Ln). At step s10, since the cleaning member 23 has been taken up so as to be in a state of capable of cleaning with the clean portion, the control portion 54 initializes the integrated value (Y2) (in the embodiment, to zero sheet) which can be also called as an index for the soiling degree of the cleaning member 23.

At step s11 is determined whether there is next print process or not. This determination is conducted by the control portion 54. Since the previous print request includes the information of the number of the printing sheets, the control portion 54 can determine whether there is next printing or not by counting the number of times of the print process. When there is no next print process, the operation proceeds to step s12 and when there is a next print process, the operation returns to the step s6 and the subsequent steps are repeated. At step s12, the integrated value (Y2) is replaced by the integrated value (Y1) and stored in the memory 31, and then the operation proceeds to End of step s13.

At the End of step s13, the main power of the image forming apparatus 50 can be turned off so as to end the image forming operation. In this case, a next image forming operation resumes from the step s1. Moreover, at the End of step s13, it is also possible to bring a standby state that the print process is not operated, but neither is the main power turned off. In this case, the next image forming operation resumes from the print request at step s3.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device for fusing and fixing an unfixed developer onto a recording medium, comprising:

fixing rollers which form a pair of rotators, a recording medium which has an image of an unfixed developer thereon being passed through a pressure-contact section formed by the fixing rollers;

a belt-shaped cleaning member provided so as to contact at least either one of fixing rollers, for cleaning a surface of the fixing roller;

a pressure-contact roller provided so as to press the cleaning member against the fixing roller which is in contact with the cleaning member, and form a nip section serving as a pressing portion;

a feeding roller for feeding the belt-shaped cleaning member which has been rolled up;

a winding roller for taking up the cleaning member which has been fed from the feeding roller and cleaned the surface of the fixing roller;

a first guide roller provided between the pressure-contact roller and the winding roller so as to contact the cleaning member, a second guide roller provided between the feeding roller and the pressure-contact roller so as to contact the cleaning member;

control means for controlling rotary operation of the feeding roller and winding roller so that a sum of a feed amount of the cleaning member which is fed by the feeding roller at one feeding occasion, and a take-up amount of the cleaning member which is taken up by the winding roller at one take-up occasion, is equal to or more than a double of a length of the nip section in a circumferential direction of the pressure-contact roller; and developer removing means for removing a developer existent on a surface of a surface of a to-be-taken-up cleaning member provided on a periphery of the winding roller.

2. The fixing device of claim 1, wherein the feed amount of the cleaning member which is fed by the feeding roller at one feeding occasion is determined according to a length of rotational time of the feeding roller controlled by the control means, and the take-up amount of the cleaning member which is taken up by the winding roller at one take-up occasion is determined according to a length of rotational time of the winding roller controlled by the control means.

3. The fixing device of claim 2, the control means controls each of the feeding roller and the winding roller with respect to the length of rotational time so that the feed amount of the cleaning member which is fed by the feeding roller at one feeding occasion, and the take-up amount of the cleaning member which is taken up by the winding roller at one take-up occasion, are equal.

4. The fixing device of claim 2, wherein the control means controls the rotary operation of the winding roller so that the length of rotational time of the winding roller is shorter than that of rotational time needed for taking up the cleaning member at one take-up occasion by an amount which is equal to the amount of the cleaning member fed by the feeding roller at one feeding occasion.

5. An image forming apparatus for forming a print image in electrophotography, comprising the fixing device of claim 1.

6. The fixing device of claim 1, wherein in a cross section perpendicular to an axial line of one of the fixing rollers, a straight line formed by the cleaning member stretched between the first guide roller and the second guide roller extends in a tangential direction with respect to an outer circumferential surface of the one of the fixing rollers.

7. A fixing device for fusing and fixing an unfixed developer onto a recording medium, comprising:

fixing rollers which form a pair of rotators, a recording medium which has an image of an unfixed developer thereon being passed through a pressure-contact section formed by the fixing rollers;

a belt-shaped cleaning member provided so as to contact at least either one of fixing rollers, for cleaning a surface of the fixing roller;

a pressure-contact roller provided so as to press the cleaning member against the fixing roller which is in contact with the cleaning member, and form a nip section serving as a pressing portion;

a feeding roller for feeding the belt-shaped cleaning member which has been rolled up;

a winding roller for taking up the cleaning member which has been fed from the feeding roller and cleaned the surface of the fixing roller; and control means for controlling rotary operation of the feeding roller and winding roller so that a sum of a feed amount of the cleaning member which is fed by the feeding roller at one feeding occasion, and a take-up amount of the cleaning member which is taken up by the winding roller at one take-up occasion, is equal to or more than a double of a length of the nip section in a circumferential direction of the pressure-contact roller, developer removing means for removing a developer existent on a surface of a to-be-taken-up cleaning member provided on a periphery of the winding roller, wherein the feed amount of the cleaning member which is fed by the feeding roller at one feeding occasion is determined according to a length of rotational time of the feeding roller controlled by the control means, and the take-up amount of the cleaning member which is taken up by the winding roller at one take-up occasion is determined according to a length of rotational time of the winding roller controlled by the control means, wherein the control means controls each of the feeding roller and the winding roller with respect to the length of rotational time so that the feed amount of the cleaning member which is fed by the feeding roller at one feeding occasion, and the take-up amount of the cleaning member which is taken up by the winding roller at one take-up occasion, are equal, and wherein the control means controls the rotary operation of the winding roller so that the length of rotational time of the winding roller is shorter than that of rotational time needed for taking up the cleaning member at one take-up occasion by an amount which is equal to the amount of the cleaning member fed by the feeding roller at one feeding occasion.

8. A fixing device for fusing and fixing an unfixed developer onto a recording medium, comprising:

fixing rollers which form a pair of rotators, a recording medium which has an image of an unfixed developer thereon being passed through a pressure-contact section formed by the fixing rollers;

a belt-shaped cleaning member provided so as to contact at least either one of fixing rollers, for cleaning a surface of the fixing roller;

a pressure-contact roller provided so as to press the cleaning member against the fixing roller which is in contact with the cleaning member, and form a nip section serving as a pressing portion;

a feeding roller for feeding the belt-shaped cleaning member which has been rolled up;

a winding roller for taking up the cleaning member which has been fed from the feeding roller and cleaned the surface of the fixing roller;

developer removing means for removing s developer existent on a surface of a surface of a to-be-taken-up cleaning member provided on a periphery of the winding roller; and control means for controlling rotary operation of the feeding roller and winding roller so that a sum of a feed amount of the cleaning member which is fed by the feeding roller at one feeding occasion, and a take-up amount of the cleaning member which is taken up by the winding roller at one take-up occasion, is equal to or more than a double of a length of the nip section in a circumferential direction of the pressure-contact roller.

* * * * *